US006062703A

United States Patent [19]

Tsao

[11] Patent Number: 6,062,703

[45] Date of Patent: May 16, 2000

[54] MULTI-PURPOSE WORKING LIGHT

[75] Inventor: Frank Tsao, Taipei, Taiwan

[73] Assignee: Caster Lighting Inc., Taipei Hsien, Taiwan

[21] Appl. No.: 09/268,309

[22] Filed: Mar. 16, 1999

[51] Int. Cl.[7] ..... F21V 21/08

[52] U.S. Cl. ..... 362/184; 191/225; 191/275; 191/396

[58] Field of Search ..... 362/184, 185, 362/186, 190, 191, 225, 260, 269, 275, 287, 396, 427

[56] References Cited

U.S. PATENT DOCUMENTS 4,598,344 7/1986 Nadler ..... 362/260
5,414,608 5/1995 Stekelenburg ..... 362/396
5,702,175 12/1997 Chen ..... 362/191

*Primary Examiner*—Y. Quach
*Attorney, Agent, or Firm*—A & J

[57] ABSTRACT

A multi-purpose working light includes a body portion having a first end provided with a plurality of fluorescent lamps and a second end formed with a notch thereby forming two lugs, each of the lugs having an outer side with a first circular recess and a center hole and an inner side with a plurality of first radial raised lines, a dog having two opposite sides each provided with a plurality of second radial raised lines and fitted in the notch, the dog having a threaded hole having a center line perpendicular to an axis going through the two opposite sides, a protective cap threadedly engaged with the body portion, and a lampshade fitted over the protective cap and threadedly engaged with the protective cap.

5 Claims, 9 Drawing Sheets

MULTI-PURPOSE WORKING LIGHT

BACKGROUND OF THE INVENTION

1. Field of the Invention

This invention is related to a multi-purpose working light and in particular to one which can be conveniently adjusted to give light to any desired place.

2. Description of the Prior Art

It is necessary to use a lamp to produce light when desired to do some repairs in the dark. However, the conventional lamp is difficult to be kept at a desired position thereby causing much inconvenience and wasting a lot of time in use.

Therefore, it is an object of the present invention to provide a multi-purpose working light which can obviate and mitigate the above-mentioned drawbacks.

SUMMARY OF THE INVENTION

This invention is related to an improved multi-purpose working light.

It is the primary object of the present invention to provide a multi-purpose working light which can be conveniently adjusted to give light to any desired place.

It is another object of the present invention to provide a multi-purpose working light which can be suspended from any article.

It is still another object of the present invention to provide a multi-purpose working light which can be fixed on a table.

It is still another object of the present invention to provide a multi-purpose working light which can stand steadily on an uneven ground.

It is a further object of the present invention to provide a multi-purpose working light which is fit for practical use.

According to a preferred embodiment of the present invention, a multi-purpose working light includes a body portion having a first end provided with a plurality of fluorescent lamps and a second end formed with a notch thereby forming two lugs, each of the lugs having an outer side with a first circular recess and a center hole and an inner side with a plurality of first radial raised lines, a dog having two opposite sides each provided with a plurality of second radial raised lines and fitted in the notch, the dog having a threaded hole having a center line perpendicular to an axis going through the two opposite sides, a protective cap threadedly engaged with the body portion, and a lampshade fitted over the protective cap and threadedly engaged with the protective cap.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
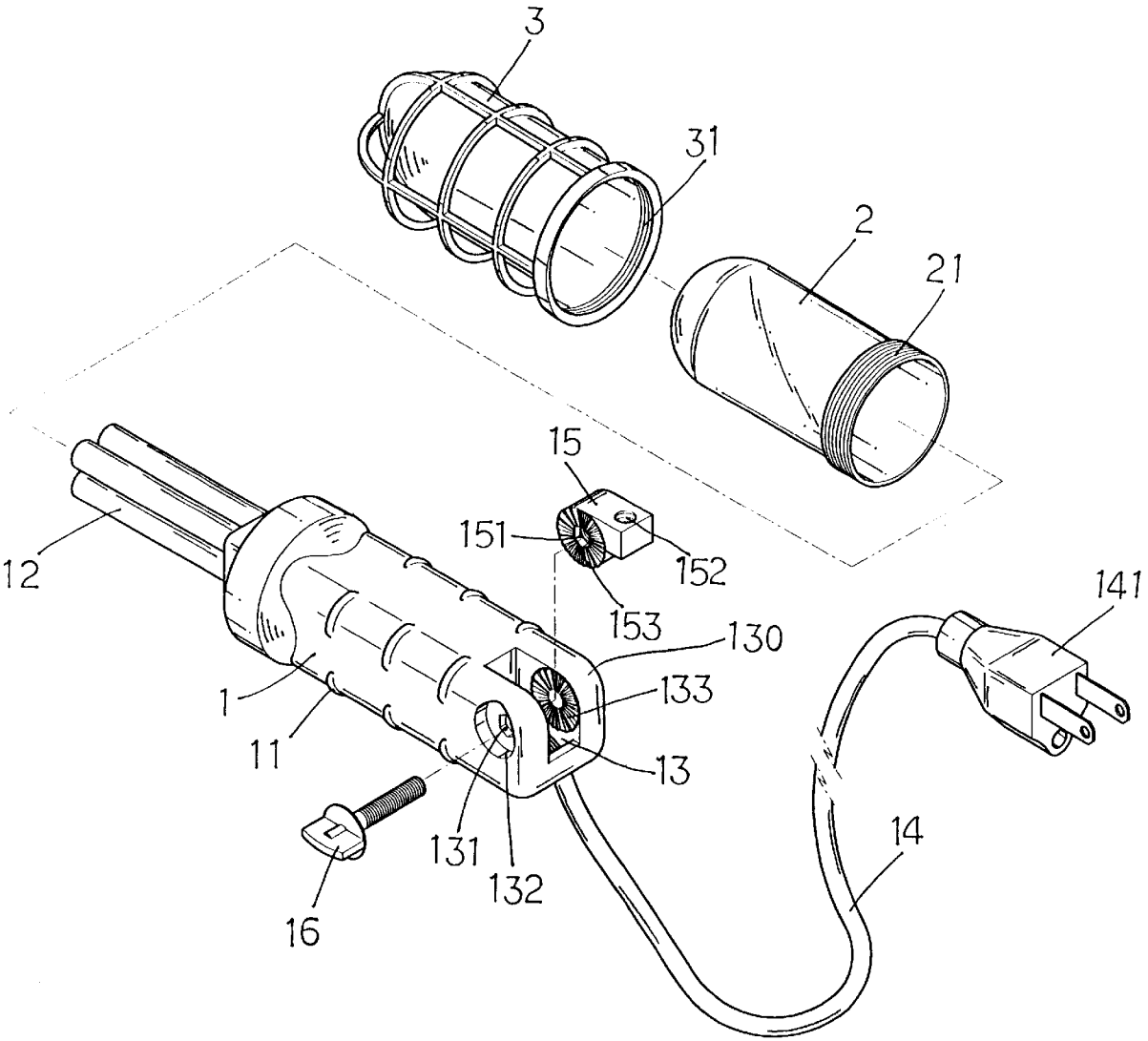
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
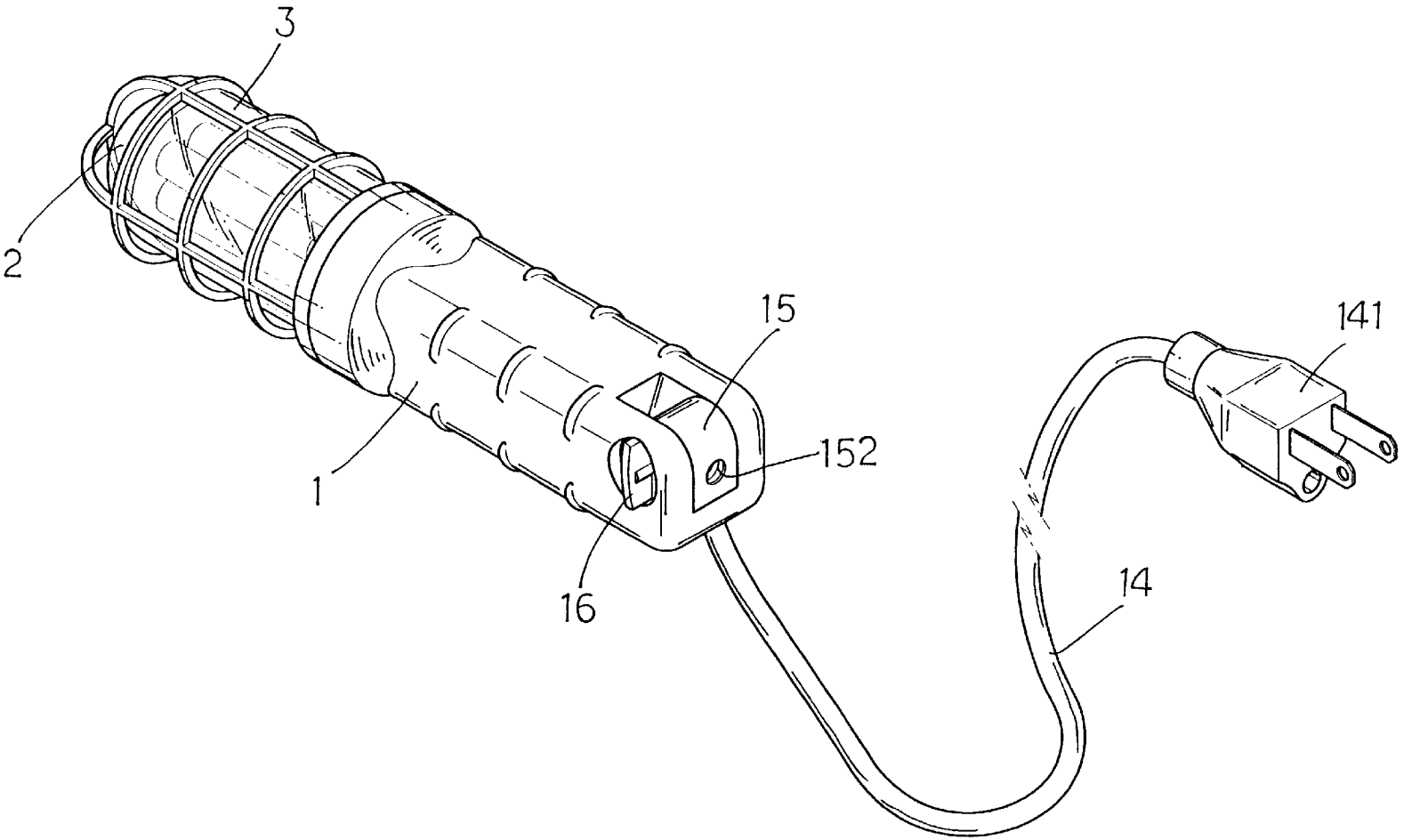
FIG. 2 is a perspective view of the present invention.

Referring to FIGS. 1 and 2, the multi-purpose working light according to the present invention generally comprises a body portion 1, a protective cap 2 and a lampshade 3.

The body portion 1 is an elongated member formed with raised lines 11 along its length for preventing slippery and has an end is provided with a plurality of fluorescent lamps 12 and another end formed with a notch 13 thereby forming two lugs 130. The body portion 1 has a longitudinal passage (not shown) so that an electrical cord 14 extends through the longitudinal passage to connect with the electrical socket at one end and with a plug 141 at another end. The lug 130 is formed at the outer side with a circular recess 132 and a center hole 131 and at the inner side,with a plurality of radial raised lines 133. A dog 15 which has a center hole 151 aligned with the center holes 131, a vertical threaded hole 152 having a center line perpendicular to an axis of the center hole 151, and a plurality of radial raised lines 153 at both ends engageable with the radial raised lines 133 is fitted in the notch 13. A bolt 16 extends through the lugs 130 of the body portion 1 and the dog 15 thereby enabling the dog 15 to rotate with respect to the body portion 1.

The protective cap 2 is a cylindrical member fitted over the fluorescent lamps 12 and has an open end formed with external threads 21 engaged with internal threads (not shown) at the upper end of the body portion 1. The lampshade 3 has an open end formed with internal threads engageable with the external threads 21 of the protective cap.

Figure 3:
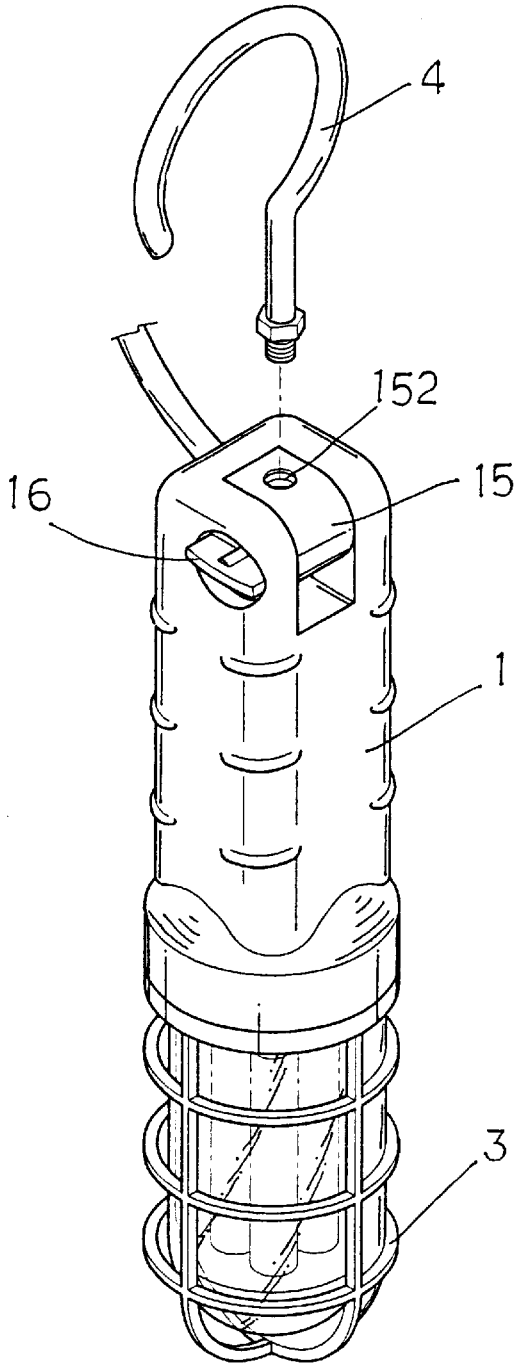
FIG. 3 illustrates a second preferred embodiment of the present invention.
Figure 4:
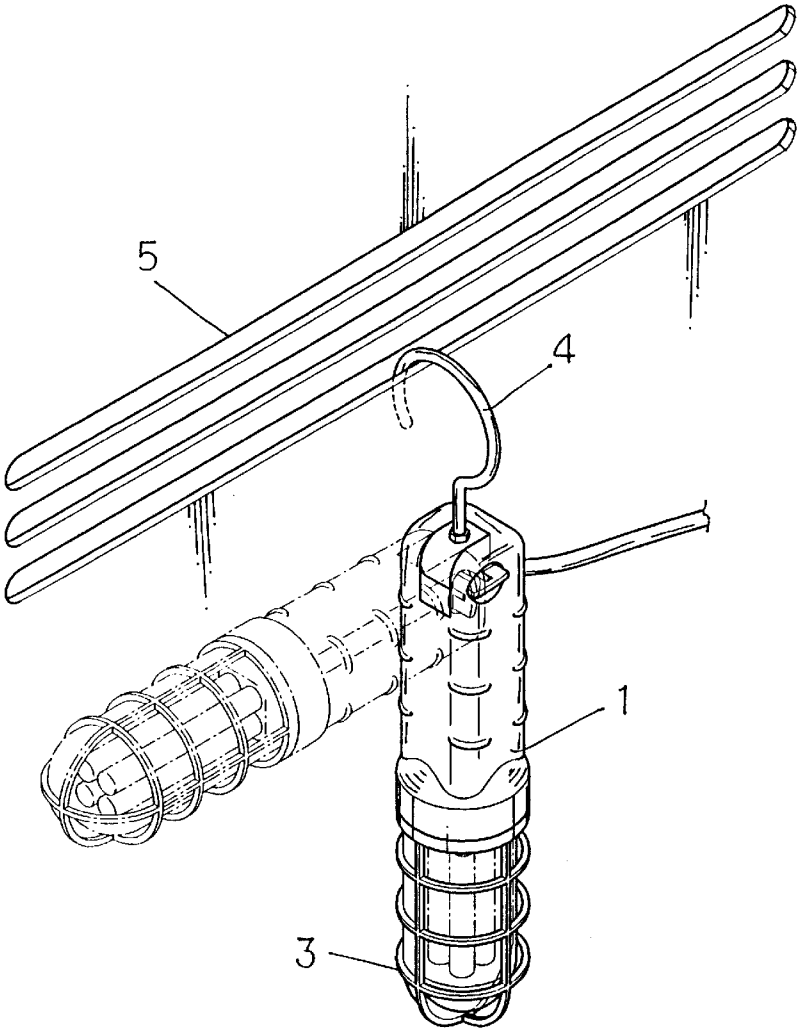
FIG. 4 illustrates how to suspend the present invention on a hood of an automobile.

Referring to FIG. 3, a hook 4 may be threadedly engaged with the vertical threaded hole 152 of the dog 15 so that the present invention can be conveniently suspended from any desired place such as a hood 5 (see FIG. 4) of an automobile. In addition, the fluorescent lamps 12 can be turned together with the body portion 1 with respect to the hook 4 and the bolt 16 thereby enabling it to give light to any desired place.

Figure 5:
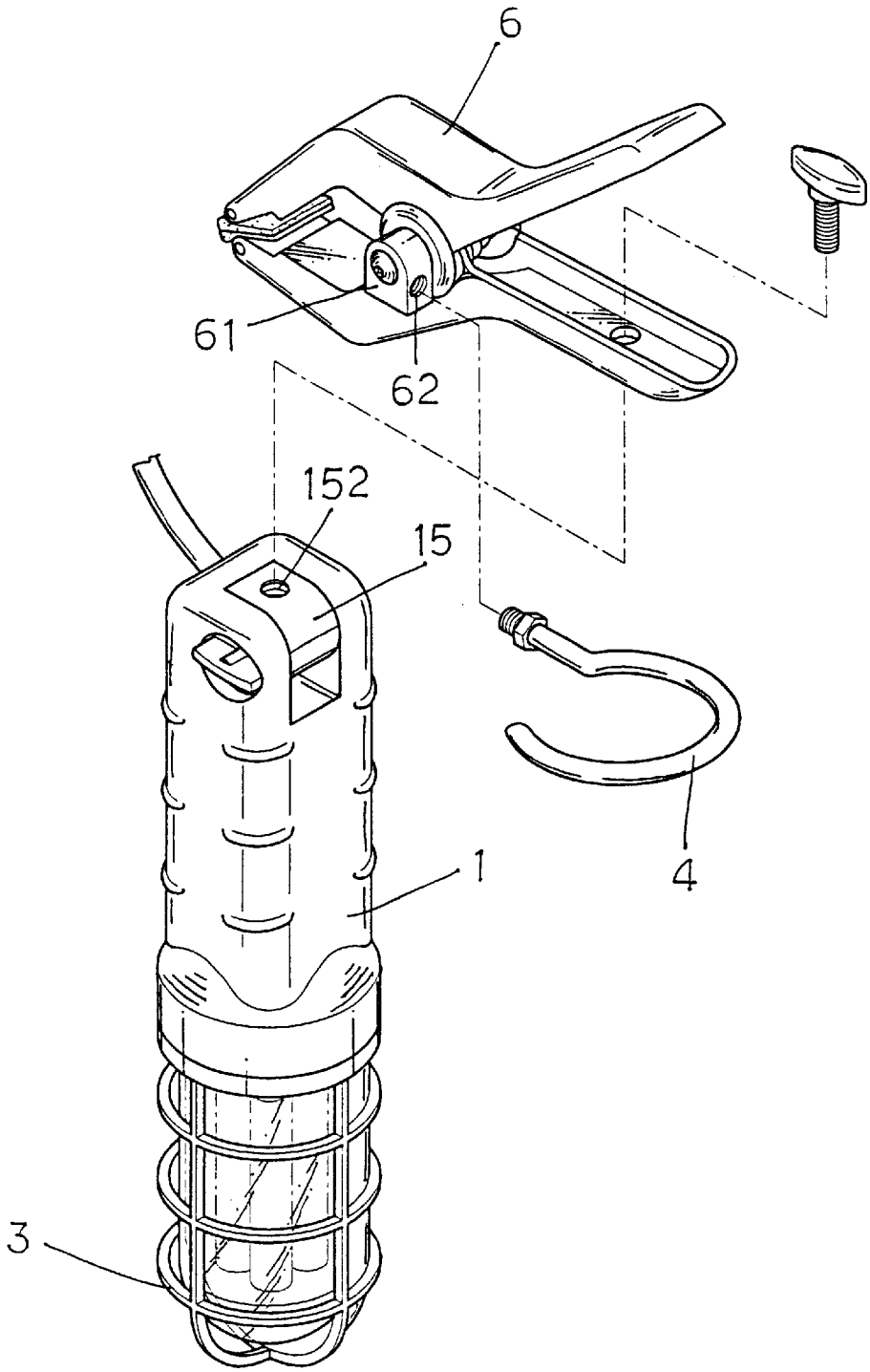
FIG. 5 illustrates a third preferred embodiment of the present invention.
Figure 6:
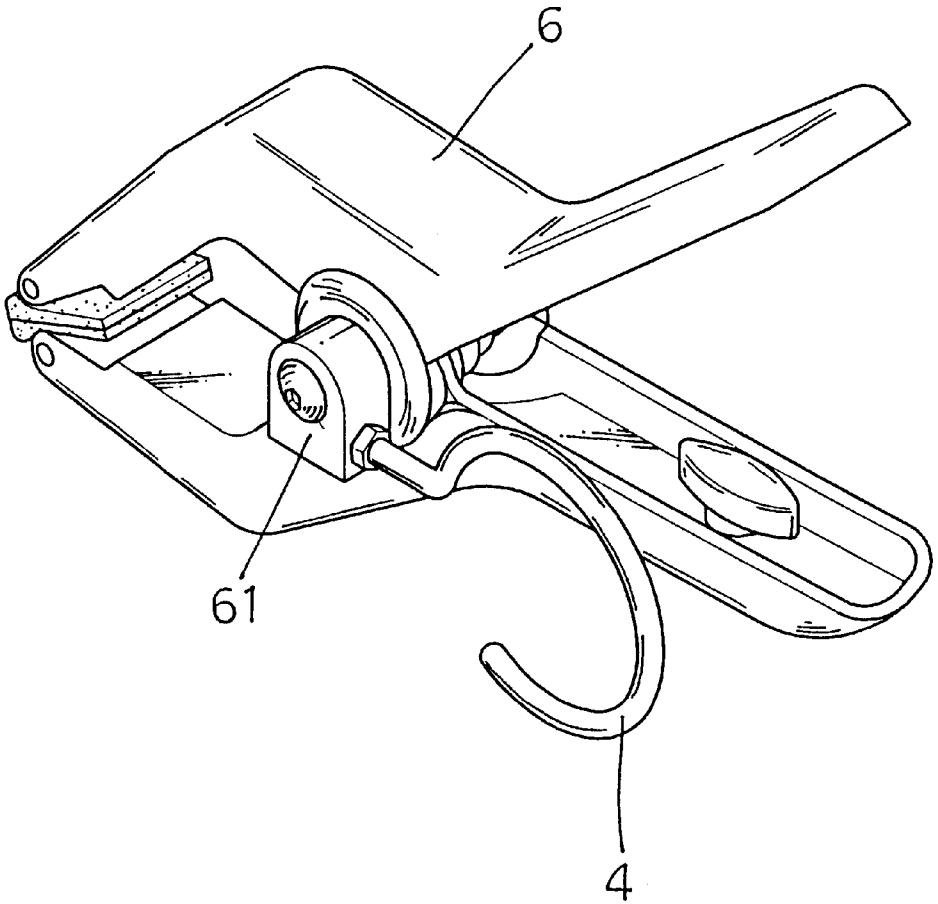
FIG. 6 is a perspective view of the clamp.
Figure 7:
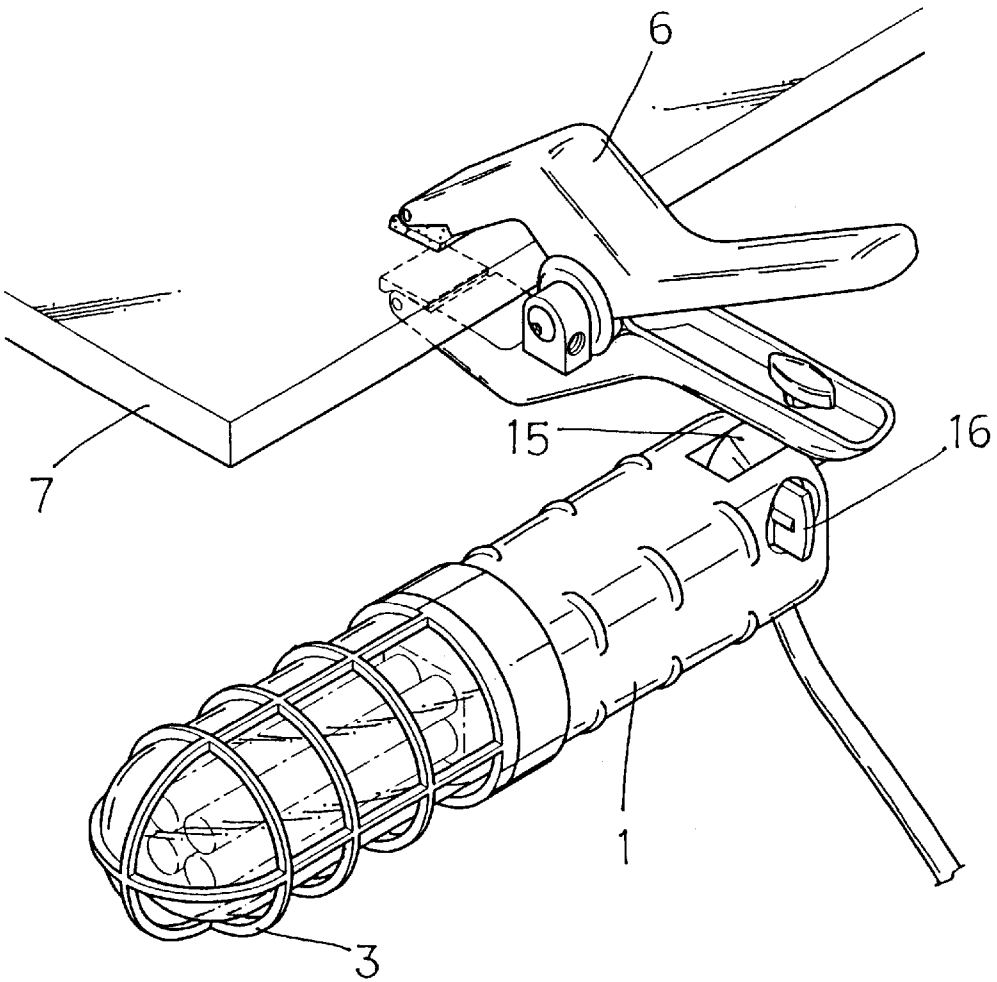
FIG. 7 illustrates how to fix the present invention on a table.

Referring to FIG. 5, a clamp 6 may be threadedly engaged with the dog 15 by a screw extending through an arm of the clamp 6 into the vertical threaded hole 152 of the dog 15. The clamp 6 has a block 61 formed with a threaded hole 62 engaged with the hook 4 (see FIG. 6) so that the clamp 6 can be mounted on a table 7 or the like to arrange the lamp at any desired position (see FIG. 7).

Figure 8:
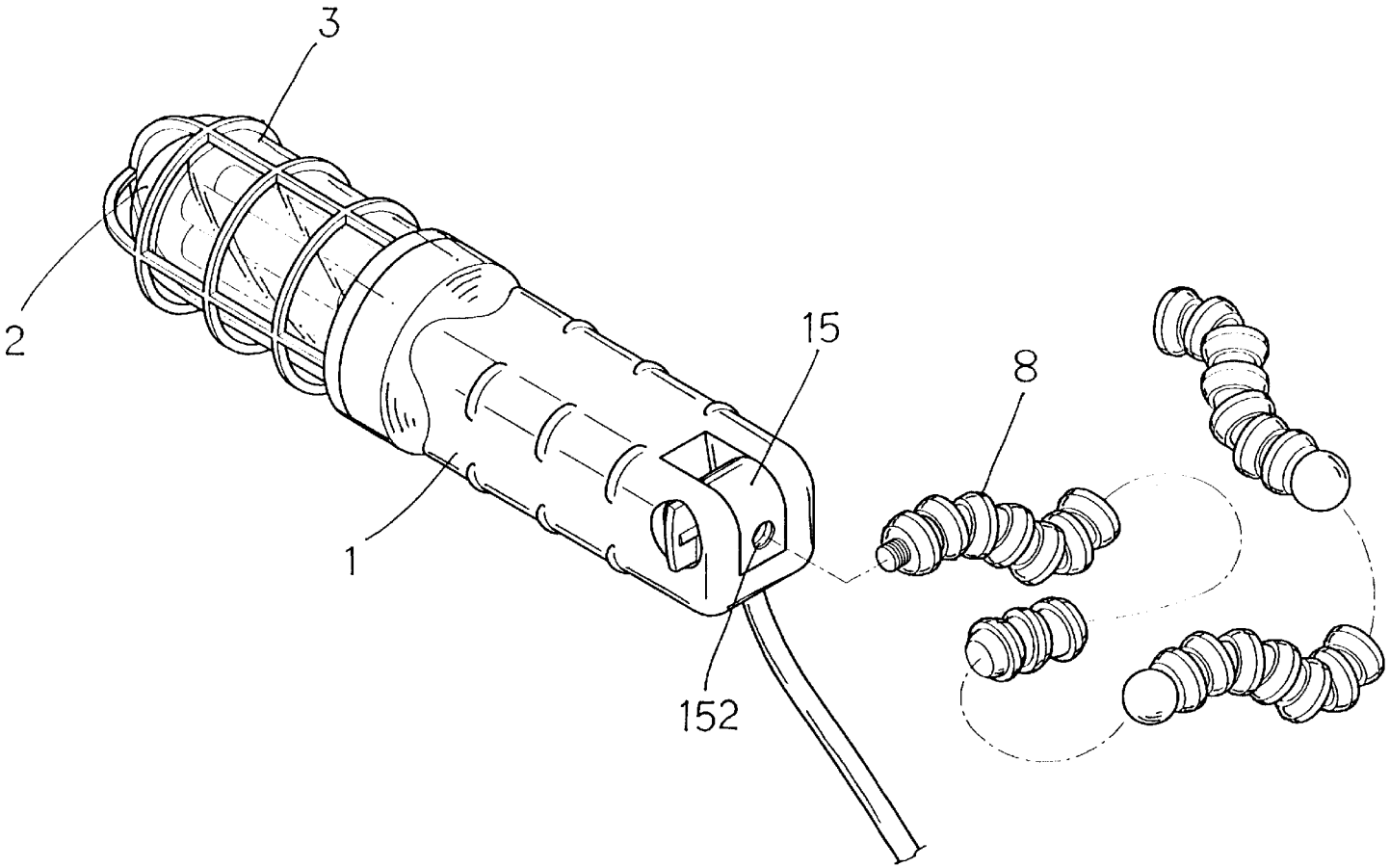
FIG. 8 illustrates a fourth preferred embodiment of the present invention.
Figure 9:
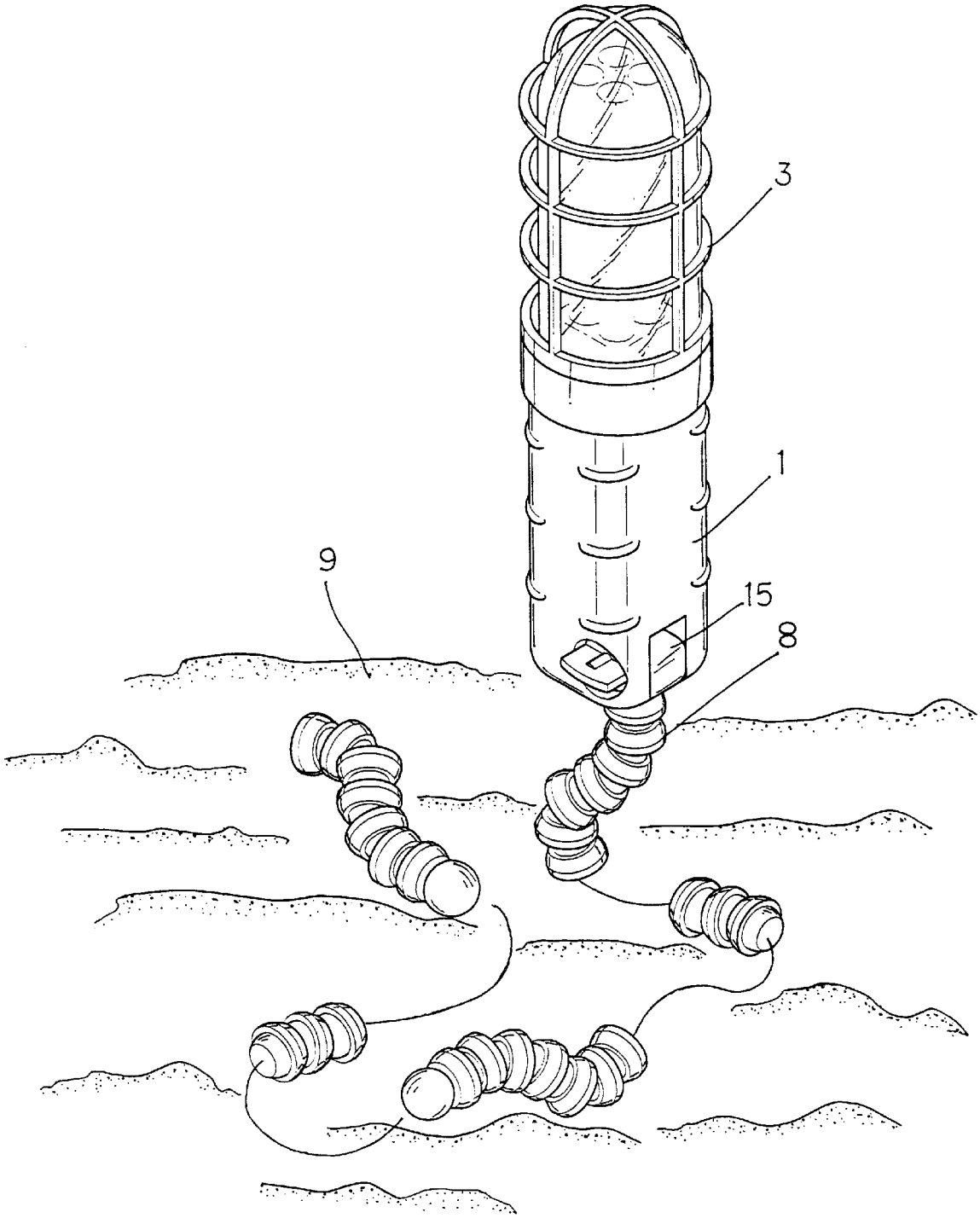
FIG. 9 is a working view of the fourth preferred embodiment.

Referring to FIG. 8, the threaded hole 152 of the dog 15 may be connected with a flexible tube 8 so that the flexible tube 8 can be adjusted to enable the lamp to stand upright on an uneven ground 9 (see FIG. 9).

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-purpose working light comprising:

a body portion having a first end connecting to a plurality of fluorescent lamps and a second end having a notch thereby forming two lugs, each of said lugs of said second end having an outer side with a first circular recess and a center hole and an inner side with a plurality of first radial raised lines;

a dog having two opposite sides, each of said sides having a plurality of second radial raised lines, said dog fitted in said notch and connecting to said notch by a bolt, said dog having a threaded hole having a center line perpendicular to an axis going through said two opposite sides;

a protective cap threadedly engaged with said body portion; and a lampshade fitted over said protective cap and threadedly engaged with said protective cap.

2. The multi-purpose working light as claimed in claim 1, wherein said body portion is formed with raised lines for preventing slippery.

3. The multi-purpose working light as claimed in claim 1, further comprising a hook engaged with said threaded hole.

4. The multi-purpose working light as claimed in claim 1, further comprising a clamp engaged with said dog by a bolt.

5. The multi-purpose working light as claimed in claim 1, further comprising a flexible tube having fastening means engaged with said threaded hole of said dog.

* * * * *